US006358621B1

(12) United States Patent
Hughes et al.

(10) Patent No.: US 6,358,621 B1
(45) Date of Patent: Mar. 19, 2002

(54) SYNTHETIC ASPHALT

(75) Inventors: Richard Howard Hughes; Jacquiline Nadine Redding, both of Haywards Heath (GB)

(73) Assignee: Fibrescreed Limited, East Sussex (GB)

( * ) Notice: Subject to any disclaimer, the term of this patent is extended or adjusted under 35 U.S.C. 154(b) by 0 days.

(21) Appl. No.: 09/135,991

(22) Filed: Aug. 18, 1998

(30) Foreign Application Priority Data

Aug. 19, 1997 (GB) ..... 9717549

(51) Int. Cl.[7] ..... B32B 11/06; C04B 14/00

(52) U.S. Cl. ..... 428/489; 428/143; 428/402; 524/445; 106/721; 404/32

(58) Field of Search ..... 524/445; 428/156, 428/15, 143, 207, 402, 489; 106/721; 404/32

(56) References Cited

U.S. PATENT DOCUMENTS 4,132,701 A 1/1979 Tapis ..... 260/42
4,437,896 A 3/1984 Partanen ..... 106/273 R
4,690,958 A * 9/1987 Lacoste et al. ..... 523/172
5,215,402 A 6/1993 Stowell et al. ..... 404/93
5,244,304 A * 9/1993 Weill et al. ..... 404/67
5,560,734 A * 10/1996 Mcintosh et al. ..... 404/15
5,651,816 A * 7/1997 Kobayashi et al. ..... 106/38.35
5,710,196 A * 1/1998 Willard ..... 524/68
5,736,197 A * 4/1998 Graveske ..... 427/393
5,849,218 A * 12/1998 Johansen, Jr. et al. ... 252/301.4 R

FOREIGN PATENT DOCUMENTS

GB 2 268 748 A 1/1994
GB 2 270 532 A 3/1994

* cited by examiner

*Primary Examiner*—Donald J. Loney
(74) *Attorney, Agent, or Firm*—Hoffman & Baron, LLP

(57) ABSTRACT

There is disclosed a synthetic asphalt comprising a synthetic bitumen mixed with filler and aggregate. Pigments may be added to the synthetic asphalt so as to produce a wide range of differently-colored surfacing materials. The synthetic asphalt may be applied hot and embossed with a groove pattern so as to simulate a block paved surface.

9 Claims, No Drawings

SYNTHETIC ASPHALT

The present invention relates to a synthetic asphalt, and in particular, but not exclusively, to the use of such a material with an embossing process to produce a patterned road surfacing.

It is known from U.K. Pat. No. 2 270 532, the disclosure of which is incorporated into the present application by reference, to provide a bitumastic surfacing material in which a pattern may be imprinted so as to simulate block paving or the like.

This simulated paved surfacing has an attractive appearance and a ride quality and "feel" similar to that of traditional block paving, but without the associated expense and difficulty of installation. In many situations, the surfacing material may be applied hot directly to an existing surface, provided that this is in relatively sound condition, thereby avoiding the need for excavation and other foundation works usually required with traditional block paving products. The surfacing material is quick to install, and may be imprinted or embossed with the desired pattern prior to cooling. Furthermore, the surfacing material can be driven over as soon as it has cooled to an ambient temperature.

In many applications, it is desirable to provide a coloured surface. However, since natural bitumen is dark brown to black in colour, it is very difficult and costly to make the known surfacing material in colours other than dark browns, dark reds and dark fawns. It is possible to apply a coloured coating over the top of the surfacing material, but this involves additional cost, and such a coating will eventually be worn away by passing traffic.

According to a first aspect of the present invention, there is provided a surfacing material comprising a synthetic bitumen mixed with filler and aggregate.

The synthetic bitumen is a resinous material and may comprise binder resin and/or polymers and/or plasticizers. In preferred embodiments, the surfacing material further comprises reinforcing fibers and/or a rheology modifier. The rheology modifier may take the form of an oxidized polyolefin, bentonite and its derivatives, synthetic waxes or siliceous materials, for example. Furthermore, some fiber additives can also serve as rheology modifiers. Advantageously the surfacing material also includes one or more pigments.

The surfacing material of the present invention may be used as a wearing course, and may typically be laid to a depth of 5 mm to 50 mm. In normal circumstances, a depth of around 15 to 20 mm is found to be most practical.

According to a second aspect of the present invention, there is provided a layer of material having a simulated paved surface, comprising a synthetic bitumen mixed with filler and aggregate, a groove pattern having been impressed into an upper surface of the layer so as to simulate the joints in a block or brick paved surface.

The material may be laid hot and be imprinted with a predetermined pattern before cooling. Alternatively, the material may be allowed to cool, and is later softened by locally applied heat so to allow the pattern to be imprinted. The pattern may be applied by way of a molding tool incorporating a shaped roller, or alternatively by way of pressing a mesh onto the top of the surfacing material, or by any other suitable process.

According to a third aspect of the present invention, there is provided a method of laying a simulated paved surface which comprises spreading a layer of molten material as described hereinabove on a foundation layer, allowing the material to cool and set, heating the surface of the material to soften it for molding purposes, and imprinting the softened surface with a pattern of grooves.

The surfacing material of the present invention may be regarded as a synthetic asphalt which, like traditional asphalt, is applied hot. Upon cooling and finishing, the surfacing material displays good stability and durability to traffic. In traditional asphalts, dark brown or black natural bitumen is used as a binder. Natural asphalts are therefore difficult to pigment effectively, and bright or pale colours are not achievable. In contrast, the synthetic bitumen of the present invention may formulated so as to have a generally white or similarly neutral base colour, and may therefore be easily coloured by the addition of suitable pigments. In this way, many different colours, including bright and pale colours, may be incorporated.

Furthermore, unlike traditional asphalt, the surfacing material of the present invention can be mixed and supplied in granular or powder form, and need only be heated immediately prior to laying. This helps to save energy, and also helps to preserve the intensity of any colour which may have been added, since repeated heating and cooling is detrimental to many pigments. It is also necessary to control the formulation of a traditional asphalt to a high degree of accuracy, since the hardness or softness, for example, of a traditional asphalt is critically dependent on the volume of bituminous binder, and the use of only slightly too much or too little binder can result in an unusable asphalt formulation. The synthetic bitumen of the present invention will generally have a less critical effect on the properties of the resultant asphalt.

In some embodiments, the surfacing material of the present invention may be supplied in granular or powder form and contained within a plastics bag incorporating predetermined polymers. The bag and its contents may be placed in a heater and melted together, the polymers of the bag mixing with the granular material during melting.

A particularly preferred composition for the surfacing material of the present invention comprises approximately: 5% to 20% binder resin, 1% to 5% polymer, 1% to 5% plasticizer, 0% to 5% pigment, 25% to 50% filler, 30% to 40% aggregate, 0% to 2% reinforcing fiber and 0% to 1% rheology modifier.

The surfacing material is preferably formulated so as to provide a balance of good processing characteristics to facilitate application such that the material spreads well and forms a good bond to the substrate.

The optional rheology modifier and reinforcing fiber components help to control the flow properties of the surfacing material in its molten state. These are generally chosen so as to facilitate the embossing process, for example by enabling the material to be imprinted without faults such as dragging, lifting and/or slump of the semi-molten material.

The rheology of the binder is further modified by the inclusion of predetermined polymer materials. The use of polymers also serves to enhance the characteristics of the binder by extending the performance over a wide range of temperatures. For example, flexibility at low temperatures is improved thus reducing cracking and embrittlement, and at high temperatures the resistance to flow and deformation, particularly under the action of vehicles, is also improved.

Further and significant improvements to the strength and resistance to traffic effects is obtained by the use of fibrous additives, such as glass, metal or cellulose fibers. Two types of fiber have been found to enhance the properties. A short fiber of given size range, e.g. 200 $\mu$m to 2000 $\mu$m, to improve hardness and strength, and a longer fiber length, e.g. 5 mm to 30 mm, to enhance cohesive properties of the surface.

What is claimed is:

1. A surfacing material comprising a synthetic bitumen mixed with 25% to 50% filler and 30% to 40% aggregate, wherein said synthetic bitumen comprises from about 5% to about 20% binder resin, from about 1% to about 5% polymer, from about 1% to about 5% plasticizer, from about 0% to 5% pigment, from about 0% to 2% reinforcing fiber and from about 0% to 1% rheology modifier.

2. A material as claimed in claim 1, wherein the reinforcing fibers are selected from the group consisting of glass, metal and cellulose fibers.

3. A material as claimed in claim 1, wherein the rheology modifier is selected from the group consisting of oxidized polyolefin, bentonite, a bentonite derivative, synthetic waxes and siliceous materials.

4. A material as claimed in claim 1, wherein the material has a granular or powder form.

5. A material as claimed in claim 2, wherein the reinforcing fibers comprise fibers having a size of 200 $\mu$m to 2000 $\mu$m and/or fibers having a size of 5 mm to 30 mm.

6. A surfacing material suitable for use with an embossing process in which the upper surface of the material is impressed so as to simulate the joints in block or brick paved surface, comprising a synthetic bitumen mixed with 25% to 50% filler and 30% to 40% aggregate, wherein said synthetic bitumen comprises from about 5% to about 20% binder resin, from about 1% to about 5% polymer, from about 1% to about 5% plasticizer, from about 0% to 5% pigment, from about 0% to 2% reinforcing fiber and from about 0% to 1% rheology modifier.

7. A layer as claimed in claim 6, wherein the reinforcing fibers are selected from the group consisting of glass, metal and cellulose fibers.

8. A layer as claimed in claim 6, wherein the rheology modifier is selected from the group consisting of oxidized polyolefin, bentonite, a bentonite derivative, synthetic waxes and siliceous materials.

9. A material as claimed in claim 7, wherein the reinforcing fibers comprise fibers having a size of 200 $\mu$m to 2000 $\mu$m and/or fibers having a size of 5 mm to 30 mm.

* * * * *